United States Patent [19]

Thomanetz

[11] 4,398,471

[45] Aug. 16, 1983

[54] DEVICE AND METHOD FOR PYROLYZING WASTE MATERIALS

[75] Inventor: Erwin Thomanetz, Stuttgart, Fed. Rep. of Germany

[73] Assignee: Herko Pyrolyse GmbH & Co. Recycling KG, Hockenheim, Fed. Rep. of Germany

[21] Appl. No.: 387,258

[22] Filed: Jun. 10, 1982

Related U.S. Application Data

[63] Continuation of Ser. No. 147,274, May 6, 1980, abandoned.

[30] Foreign Application Priority Data

May 9, 1979 [DE] Fed. Rep. of Germany ..... 2918758

[51] Int. Cl.[3] ..... F23G 3/00

[52] U.S. Cl. ..... 110/235; 432/112; 432/113; 126/99 C; 110/255; 110/258

[58] Field of Search ..... 126/99 C; 432/112, 113; 110/235, 255, 258

[56] References Cited

U.S. PATENT DOCUMENTS

| | | | |
|---|---|---|---|
| 1,613,615 | 1/1927 | Lippert | 126/99 C |
| 1,841,625 | 1/1932 | Musso | 432/113 |
| 2,217,665 | 10/1940 | Brown | 432/112 |
| 2,500,553 | 3/1950 | Lykken | 432/112 |
| 3,751,214 | 8/1973 | Wenzel et al. | 432/112 |
| 3,955,552 | 5/1976 | Von Wiesenthal | 126/99 C |
| 4,182,246 | 1/1980 | Lombana et al. | 110/225 |

*Primary Examiner*—Henry C. Yuen

*Attorney, Agent, or Firm*—Fleit, Jacobson & Cohn

[57] ABSTRACT

This invention is a device for pyrolyzing waste materials comprising a low - temperature carbonizing reactor. The reactor includes a longitudinally extending tubular vessel adapted to be loaded with waste materials to be pyrolyzed and a flue gas duct which surrounds a shell of the carbonizing reactor, which defines an annular space which concentrically surrounds the tubular vessel, and which is adapted to have hot flue gases passed therethrough for the purpose of heating the shell of the reactor. The flue gas duct contains a baffle for maintaining turbulent flow about the reactor and for uniformly distributing the flue gases about the periphery of the tubular vessel. The baffle comprises a plurality of heat conducting elements which are disposed in planes which contain the longitudinal axis of the annular space and a plurality being disposed in planes extending at right angles to the longitudinal axis of the annular space.

6 Claims, 1 Drawing Figure

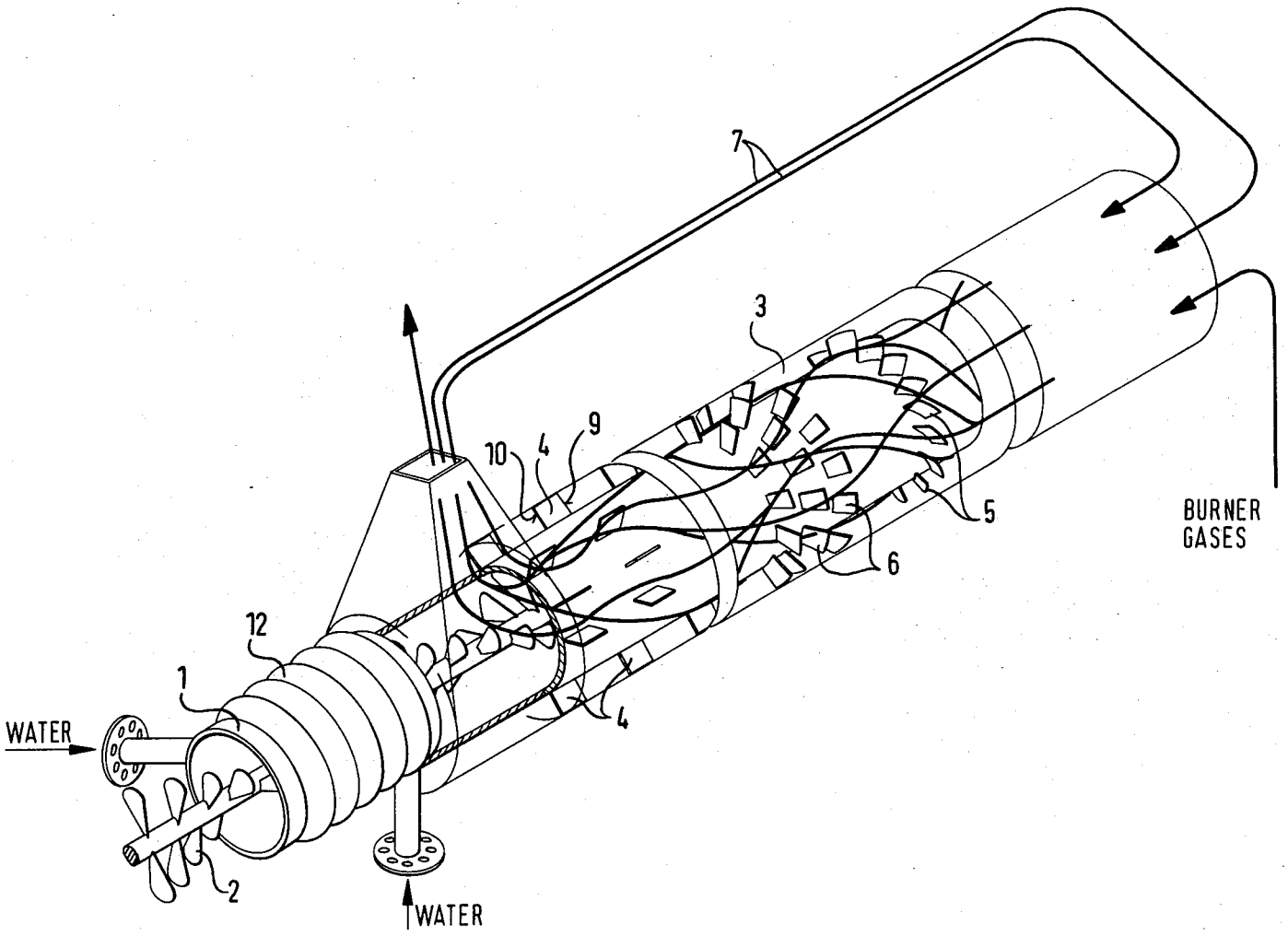
BURNER GASES
WATER
WATER
1
2
3
4
4
5
6
7
9
10
12

DEVICE AND METHOD FOR PYROLYZING WASTE MATERIALS

This is a continuation of application Ser. No. 147,274 filed May 6, 1980, now abandoned.

FIELD OF THE INVENTION

The present invention relates to a device for pyrolyzing waste materials, said device comprising a low-temperature carbonizing reactor adapted to be charged with waste materials and a flue gas duct adapted to have hot flue gases passed therethrough and to heat the shell of said reactor. Moreover, the present invention is concerned with a method of pyrolyzing waste materials in which the waste materials are passed through a low-temperature carbonizing zone and to be indirectly heated by means of hot flue gases flowing in countercurrent thereto.

DESCRIPTION OF THE PRIOR ART

A prior-art device and a prior-art method of this general nature have been disclosed in DE-OS No. 25 20 754. In this known device, the waste materials are pushed foreward in a tubular reactor which is provided, for the purpose of heating thereof, with a flue gas duct of smooth annular cylindrical shape extending the entire length of a low-temperature carbonizing zone. Flue gases are produced by means of burners in a heating chamber provided at the exit end of said tubular reactor, said flue gases escaping from said heating chamber and entering said flue gas duct at a velocity which corresponds to the rate at which they are produced. With the exception of areas in the vicinity of said heating chamber, where the presence of the burner flames still produces turbulence, the smooth walls of said flue gas duct produce a substantially laminar flow of the flue gases. Since in the presence of turbulent flow conditions the transmission of heat to the tubular reactor is considerably more intense than in the presence of laminar flow conditions, there arises the drawback that particularly at a point where the flue gases are extremely hot, i.e. in the vicinity of said heating chamber, the transmission of heat is particularly effective, thus causing thermal overloading of the tubular reactor, whereas at the end of the tubular reactor or the flue gas duct, respectively, which is remote from said heating chamber, i.e. at a point where it would be desired to cause the temperature of the flue gases which have become lower in the meantime imparted as effectively as possible to the tubular reactor, an insufficient degree of heat transmission is obtained.

OBJECT OF THE INVENTION

Therefore, it is an object of this invention to provide a device and a method of the aforeindicated type in which an efficient and uniform transmission of heat from the flue gases to the reactor shell and the material to be carbonized is obtained throughout the length of the low-temperature carbonizing zone.

SUMMARY OF THE INVENTION

According to the present invention, this object is achieved by the provision in the flue gas duct of means adapted to promote and maintain turbulent flow conditions of the flue gases throughout the length of the heating zone. These means form flow obstacles disposed in the path of the hot flue gases and adapted to prevent laminarization of the flue gas flow with increasing distance from their point of origin. By distributing such means throughout the length of the heat transmission zone it is possible to maintain turbulent flow conditions throughout this zone, the result being that even that part of the reactor shell will be heated to a sufficient extent which is being heated by flue gases which have already been cooled down partially.

In a preferred embodiment of the invention, with the low-temperature carbonizing reactor being of tubular shape and with the flue gas ducts being constituted by an annular space which concentrically surrounds the tubular reactor, said means are disposed in said annular space in such a manner as uniformly to distribute the flue gases about the periphery of the tubular reactor. Thus it is possible to prevent certain peripheral regions of the tubular reactor from being heated to a higher extent than other peripheral areas; in this manner the tubular reactor is prevented from being deformed and from possibly damaging conveyor elements such as screws of the like which are operating within the tubular reactor.

A further improvement in heat transfer is obtained in a preferred embodiment of the invention by providing for the said means or internal fittings which are in heat-conducting connection with the reactor shell or the tubular reactor, respectively, to be welded to the surface of the tubular reactor. This arrangement results in an increase in the surface area of the tubular reactor, i.e. an increase in heat transfer area. In other words, an effect is obtained which is practically the reverse of the effect of cooling fins. Said internal fittings are preferably constituted by sheet-metal members which are distributed throughout the length the flue gas duct and which are preferably disposed in planes containing the axis of said annular space. Such sheet-metal members are particularly adapted not only to increase the heat transfer surface but also to serve as baffle plates which uniformly distribute the hot flue gases about the tubular reactor and which at the same time induce turbulence by causing the gas flow to break away from their terminal edges.

In another preferred embodiment of the invention, said sheet-metal members are disposed in such a manner as to define an angle with the axis of said annular space, it being possible, if it should be required by the flow pattern which is to be achieved, to dispose the sheet-metal members also in planes which extend at right angles to the axis of the annular space. As a rule, a uniform distribution of the hot flue gases about the tubular reactor will be obtained if said sheet-metal members are equiangularly spaced about the axis of the annular space.

The said sheet-metal baffles do not only act as flow guide members and distributors for the flue gases and do not only increase the heat exchange area but also become effective as radiation converters. They are exposed to the hot flue gases and are heated substantially to the temperature of said gases; since they act as grey bodies, they give off the heat received to a much larger extent than the substantially transparent flue gases, the heat being given off in the form of radiation.

In order still further to improve the transfer of heat to the tubular reactor, there is provided, in a particularly preferred embodiment of the invention, means which are adapted to cause the flue gases to circulate at a high velocity.

As regards the method mentioned above, the said object is attained, according to the invention, by causing the hot flue gases to flow in a turbulent manner throughout the length of the low-temperature carbonizing zone. This will result, for the reasons mentioned earlier, in more effective and more uniform heating of the reactor shell and thus the waste material of the entire length of the low-temperature carbonizing zone. According to a preferred feature of the method according to the invention, the hot flue gases are subjected to force circulation. This results in a high flow velocity of the flue gases and, as a consequence, in a further improvement in heat transfer.

BRIEF DESCRIPTION OF THE DRAWING

The invention may be carried into practice in a number of ways but certain specific embodiments will now be described by way of example with reference to the accompanying drawing, wherein: The only FIGURE shows a part-sectional perspective view of a preferred embodiment of the invention.

DETAILED DESCRIPTION OF PREFERRED EMBODIMENTS

The drawing shows in a highly simplified manner a tubular reactor 1 which is surrounded by a flue gas duct 3 disposed concentrically with the reactor and extending the entire length of the low-temperature carbonizing or pyrolyzing zone intended to receive the waste materials to be pyrolyzed. In the drawing, the wall of the flue gas duct has been partially omitted so as to enable the internal fittings provided in the flue gas duct to be shown. Besides that, the flue gas duct, which is in practice constructed as a continuous duct, is shown as being composed of a plurality of axially extending sections (as is the tubular reactor), there being shown different embodiments of internal fittings. In a certain embodiment such different internal fittings may be combined, but it will be understood that embodiments are contemplated in which internal fittings of one and the same type disposed along said reactor are employed.

In operation, waste materials in the form of lumps which are supplied from an external source are conveyed, in accordance with the drawing, from the left to the right through the tubular reactor 1 made of steel by means of a vane-type conveyor screw 2 which extends through the tubular reactor from the loading end to the unloading end thereof, it being understood that in the left-hand part of the drawing part of the wall of the reactor has been omitted so as to make it possible to show part of the conveyor screw. Hot flue gases flow in countercurrent fashion through the flue gas duct 3 whose walls are formed by the tubular reactor 1 and another tube also made of steel disposed so as concentrically to surround the tubular reactor, said second tube having a suitably larger diameter. The hot flue gases are produced by burners (not shown) arranged in the vicinity of the unloading end of the reactor tube. In one embodiment of the invention, there are disposed in the flue gas duct 3 of annular-cylindrical shape, internal fittings in the form of sheet-metal members 4 which are connected, as by welding, to the outer wall of tubular reactor 1, which extend in radial planes containing the axis of the reactor, which terminate in said radial planes at the outer peripheral wall of the flue gas duct and which are spaced in axial direction from one another. The said sheet-metal members are equiangularly spaced about the tubular reactor 1 in order to obtain a uniform distribution of the flue gases about the reactor. The gas flow tends to break away from the upstream edges 9 and the downstream edges 10 (referring to the direction of flow of the flue gases) at frequent intervals so that a turbulent flow pattern is constantly produced along the entire length of the flow path, it thus being possible to maintain turbulent flow conditions throughout the length of the flue gas duct within the pyrolyzing zone, such turbulent flow affording the aforementioned advantages as regards an improvement in heat transfer. If use were made of a smooth-walled annular space having no internal fittings of the type described, it would be impossible to maintain a turbulent flow pattern throughout the length of the pyrolyzing zone, and, with increasing distance from the heating chamber in which the hot flue gases are produced by means of said burners, which burners produce a local turbulence, the gas flow would be converted into a laminar flow to an ever increasing extent. In the event use were made of a smooth-walled annular space containing no internal fittings, the decisive increase in heat transfer area described earlier which results from the employment of said sheet-metal members 4 welded to the tubular reactor 1 would not be obtained, i.e. the reverse cooling fin effect described earlier would not occur.

Also shown in the drawing are sheet-metal members 5 which are disposed in such a manner that each of them forms an angle with the longitudinal axis of the flue gas duct; in addition, the drawing shows sheet-metal members 6 which are disposed in planes extending at right angles to the flue gas duct axis. It will be understood that such sheet-metal members 5 and 6 may be employed as alternatives to the sheet-metal members 4 and that it is only for the sake of simplicity that they are shown in the single FIGURE of the drawing; where only members 5 or members 6 are provided, they will be distributed, in the same manner as the axially extending sheet-metal members 4, throughout the length of the pyrolyzing zone. However, it is also possible to employ sheet-metal members 5 and/or 6 suitably distributed along the axis of flue gas duct 3 together with sheet-metal members 4 in cases in which certain initial conditions existing in the flue gas flow or other factors appear to render such an arrangement advantageous. In still another alternative, it would be possible to employ only sheet-metal members 5 and 6 without members 4 which are alined in a longitudinal direction. Also the sheet-metal members 5 and 6 are welded to the external surface of tubular reactor 1 and extend outwardly towards the external wall flue gas duct 3.

The sheet-metal members 4, 5 and 6 are adapted to maintain turbulent flow conditions throughout the length of the pyrolyzing zone, they are adapted to distribute the flue gases in a uniform manner, thus increasing the heat transfer area, and besides that, they act as radiation converters. In contrast to the flue gases which produce radiation to a small extent only, such radiation converters come into action as grey bodies which are excellent heat radiators; after having been heated to the temperature of the flue gases surrounding them, they give off the heat to the tubular reactor in the form of radiation.

As indicated in the drawing by arrows 7, it is preferred, according to the invention, additionally to enforce circulation of the flue gases by means of a fan or blower (not shown) serving to increase the velocity of the flue gases so as still further to improve the transfer of heat and to render the heat transfer more uniform.

Upstream of the pyrolyzing zone the tubular reactor 1 is surrounded by water cooling means 12 adapted to maintain the loading end of the reactor at a suitable low temperature.

What is claimed is:

1. A device for pyrolyzing waste materials comprising a low-temperature carbonizing reactor including a longitudinally extending tubular vessel loaded with waste materials to be pyrolyzed, a flue gas duct surrounding a shell of said carbonizing reactor and defining an annular space which concentrically surrounds said tubular vessel having hot flue gases passed therethrough for the purpose of heating the shell of said reactor, and baffle means for maintaining turbulent flow disposed about said reactor in said annular space in such a way that they are to uniformly distribute the flue gases about the periphery of said tubular vessel and to produce and maintain turbulent flow conditions throughout the area to be heated, said baffle means comprising a plurality of planar heat conducting means distributed throughout the length of said flue gas duct, a plurality of said heat conducting means each being disposed in planes containing the longitudinal axis of said annular space a plurality being disposed to define an angle with the longitudinal axis of said annular space and a plurality being disposed in planes extending at right angles to the longitudinal axis of said annular space.

2. The device of claim 1, wherein said baffle means are connected to the shell of said low-temperature carbonizing reactor in heat-conducting relation.

3. The device of claim 2, wherein said baffle means are welded to the shell of said low-temperature carbonizing reactor.

4. A device according to claim 1, wherein said heating conducting means are equiangularly spaced about the longitudinal axis of said annular space.

5. A device according to claim 1, comprising additional means adapted to circulate the flue gases at a high velocity of flow.

6. The device of claim 1 wherein said heat conducting means are sheet-metal members.

* * * * *